United States Patent [19]

Lindström

[11] Patent Number: 5,044,909

[45] Date of Patent: Sep. 3, 1991

[54] VALVE DEVICE FOR CONTROL OF THE INNER VOLUME RELATION IN A SCREW TYPE ROTARY COMPRESSOR

[75] Inventor: Paul Lindström, Norrköping, Sweden

[73] Assignee: STAL Refrigeration AB, Norrköping, Sweden

[21] Appl. No.: 489,551

[22] Filed: Mar. 7, 1990

[30] Foreign Application Priority Data

Mar. 8, 1989 [SE] Sweden ..... 8900816

[51] Int. Cl.[5] ..... F04C 29/08

[52] U.S. Cl. ..... 418/201.2

[58] Field of Search ..... 418/201.1, 201.2

[56] References Cited

U.S. PATENT DOCUMENTS 3,151,806 10/1964 Whitfield ..... 418/201.2

4,946,362 8/1990 Söderlund et al. ..... 418/201.2

FOREIGN PATENT DOCUMENTS 254261 3/1988 Fed. Rep. of Germany ... 418/201.2

*Primary Examiner*—Leonard E. Smith

*Assistant Examiner*—David L. Cavanaugh

*Attorney, Agent, or Firm*—Watson, Cole, Grindle & Watson

[57] ABSTRACT

In a rotary compressor of a cooling or heat pump system, the inner volume relation should be related in a predetermined way to the pressure relation of the compressor for an optimal efficiency to be achieved. The built-in volume relation must therefore be variable to be adapted, for example, to full load and partial load. In order to achieve the highest efficiency with respect to loading requirements, a valve device has been developed, in which the outlet port is formed in such a way as to substantially correspond to the theoretically correct radial outlet port and in which a valve body (13) adapted for the purpose has its line of action oriented towards the outlet plane. The valve body is arranged in such a way that in its fully inserted position in the outlet port (12) the mantle wall will correspond to the mantle wall of the working space of the compressor, and will be adjacent to the rotors at a minimum amount of play by means of the end face having been provided with a pointed line (14) surrounded by two concave surface (15, 15). The outlet port (12) in the mantle wall of the working space of the rotary compressor is delimited by an outlet plane (9) of the compressor and by the screw lines in the mantle wall which correspond to the cam surfaces of the rotors, which cam surfaces interact in the direction of the outlet plane of the compressor.

4 Claims, 2 Drawing Sheets

VALVE DEVICE FOR CONTROL OF THE INNER VOLUME RELATION IN A SCREW TYPE ROTARY COMPRESSOR

TECHNICAL FIELD

The present invention relates to a valve device for control of the inner volume relation of a rotary compressor for cooling or heat pump systems.

PRIOR ART

In order to control the capacity of a rotary compressor in a cooling system or heat pump system, the compressor has usually been provided with an axially or tangentially displaceable slide, which is capable of opening one or more return flow channels between a working space and an inlet chamber in the compressor. Such capacity control is most frequently used in screw compressors.

In order to achieve optimal efficiency for a compressor, the built-in or so called inner volume relation of the compressor should have a defined relation to the pressure relation of the compressor. The built-in volume relation must therefore be variable, so that it can be adapted to the working conditions in a particular case. By means of, for example, an axially displaceable slide it is possible to vary and thus control the built-in volume relation. In order to steplessly control the built-in volume relation by means of known devices, a very complicated and advanced control system comprising advanced pressure gauges and usually also involving calculating operations by means of a computer is required.

Further, it is known to vary the built-in volume relation in a rotary compressor by means of radially displaceable so called lift valves, the lift valves preferably being formed as cylindrical pistons and arranged to open or close an outlet channel of the rotary compressor. With a plurality of lift valves, control can take place in steps, for which a much less complicated control system is required as compared to the previously mentioned control system for stepless control.

DESCRIPTION OF THE INVENTION

In order to facilitate mounting and removal of a valve body for control of the inner volume relation of a rotary compressor without having to dismount an outlet plane of the compressor housing itself and also to achieve higher efficiency with respect to loading requirements in a rotary compressor of a cooling system or heat pump system, a valve device for control of the inner volume relation has been provided with a valve body which is oriented towards the outlet plane and the rotors and which fits the so called theoretically correct radial outlet port. By 'theoretically correct radial outlet port' is meant the area of the mantle wall of the working space substantially defined by the outlet plane and by the screw lines corresponding to the screw lines of the screws of the rotary compressor which interact in the direction of the outlet plane. For the valve body to move towards the theoretically correct radial outlet port, the end of the inclined valve body is provided with an oblique surface for contact with the outlet plane as well as with a pointed line surrounded by concave surfaces arranged to be adjacent to the rotors at a minimum amount of play. With this new type of valve device, an end wall on the outlet side can be connected to the compressor housing and provided with a fully closed sealing line without passages for any pressure lines or valve parts. If the valve device has to be removed, like, for example, in the case of an inspection of the rotors or the valve body, the end cover or the equivalent does not have to be removed.

DESCRIPTION OF AN EMBODIMENT

In its theoretical shape, an outlet port of a twin-screw compressor is not at all circular (see FIGS 1–3), since it is delimited by the outlet side as well as by the opening in the mantle wall of the rotor housing, which opening is situated adjacent to the oblique cam surfaces of the screws. Further, the outlet port is located such that it is almost impossible to achieve any real correspondence between the so called theoretical shape of the outlet port and a cylindrical shape of a valve body.

Especially in the case of high speed compressors it has proved necesssary for the outlet port to be correctly shaped and correctly located in order not to have a negative effect on the well-known high efficiency of this type of compressor.

Figure 1:
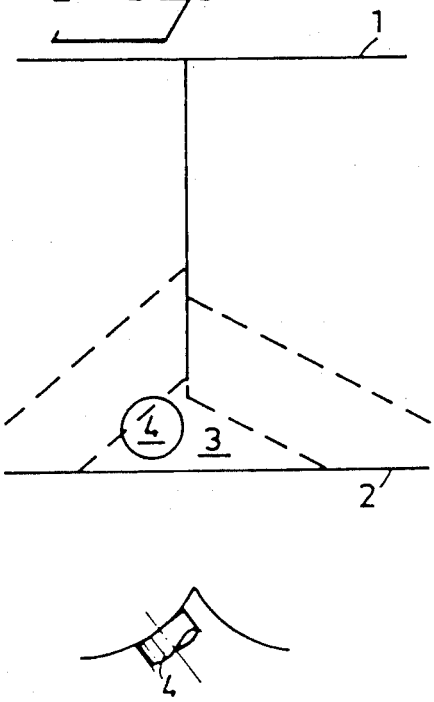
FIGS. 1–3 are axial sectional views of screw compressors with radially disposed circular outlet ports in different positions and with valve bodies adjacent to the outlet side.
Figure 2:
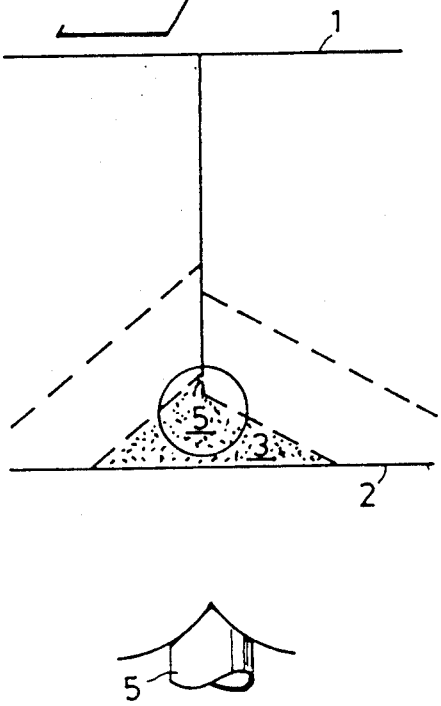
Figure 3:
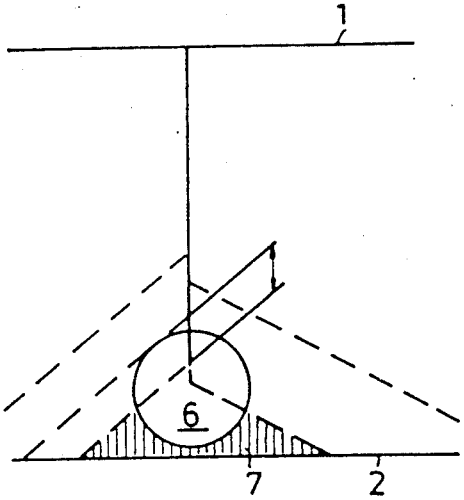

FIG. 1 is a diagrammatic sectional view of an SMR type compressor having a working space and rotors. Reference number 1 denotes the inlet side of the compressor and 2 denotes its outlet side. The radial outlet port 3 in the mantle wall of the working space which is theoretically correct for a certain inner volume relation is delimited by the outlet side 2 and by the screw lines corresponding to the oblique cam surfaces of the rotors. Reference number 4 denotes a cylindrical outlet port with a lift valve for the compressor. It is evident that the area of the cylindrical outlet port is considerably smaller and has a different shape as compared to the area of the theoretically correct radial outlet port 3. By positioning the lift valve unsymmetrically, the shape of the valve end can be simplified. If the lift valve 5 is positioned symmetrically as in FIG. 2, the area of the lift valve can be increased as compared to the area 3 of the theoretically correct outlet port, but the area of the lift valve 5 will still be slightly smaller than the area 3. If the area 6 of the lift valve according to FIG. 3 is made equally large as the theoretically correct outlet port area, the outlet valve must open much earlier than intended, which will have an effect on the built-in volume relation. As appears from FIGS. 1–3, there is no complete correspondence between the outlet area of the rotary compressor towards the mantle wall of the working space and the area of any lift valves illustrated. The area 7 of FIG. 3 denotes in itself a built-in bar to the flow in the rotary compressor.

Figure 4:
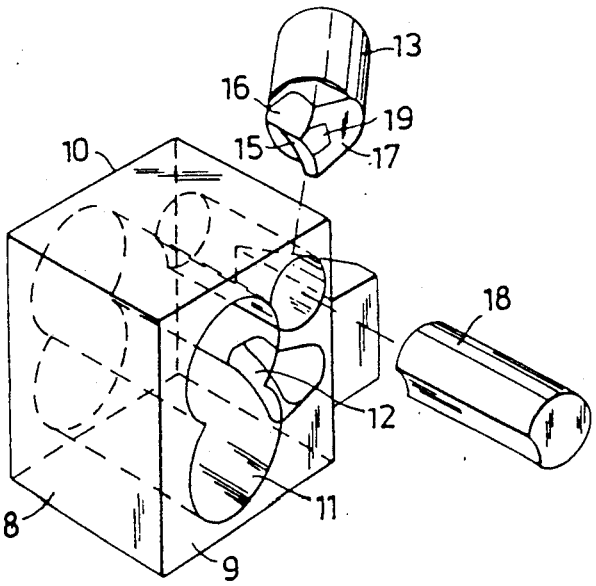
FIG. 4 is a perspective view of a twin-screw compressor housing with a relating slide valve for capacity control and with a valve device arranged for control of the inner volume relation.
Figure 5A:
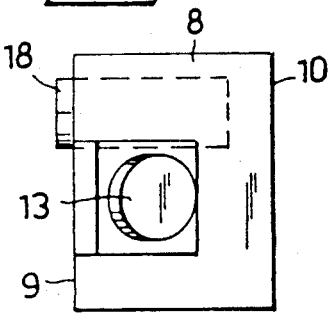
FIGS. 5*a*, 5*b* and 5*c* show the compressor housing according to the invention seen from different sides, with the slide valve and the valve device in their fully inserted positions.
Figure 5B:
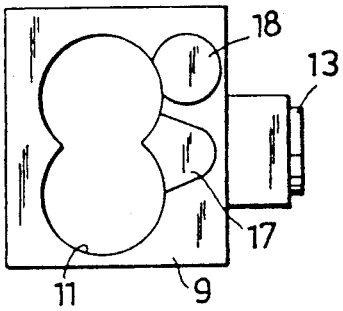
Figure 5C:
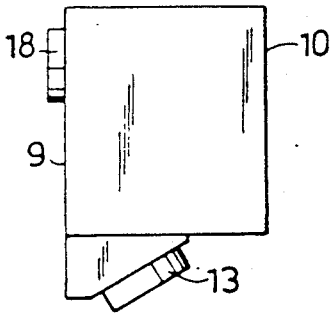
Figure 6A:
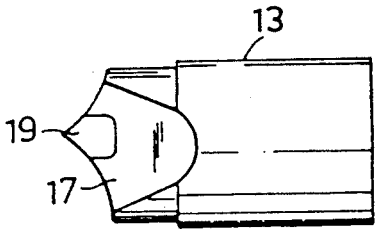
FIGS. 6*a*, 6*b* and 6*c* show various views of the actual valve body for control of the inner volume relation according to the invention.
Figure 6B:
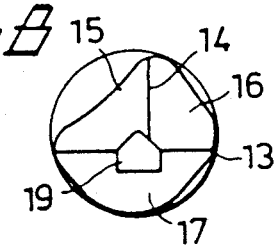
Figure 6C:
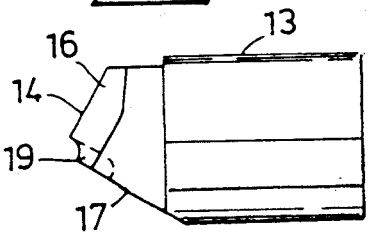

A twin-screw compressor housing according to the invention comprises a rotor housing 8 surrounding the two parallel interacting screw surfaces, the rotor housing having end walls 9, 10, see FIG. 4. The end walls 9, 10 are the axial end faces which axially delimit the working space 11 of the screw compressor. One end face/end wall 10 corresponds to the previously mentioned inlet plane 1, and the other end face/end wall 9 corresponds to the previously mentioned outlet plane 2. Adjacent to the inlet plane there is an inlet opening to the working space for the working medium. To show the relative positions of the valve functions there is depicted in FIG. 4 the possible location of a slide valve 18 for capacity control in relation to the valve device 13 for control of the inner volume relation. In the rotor housing, there is, adjacent to the outlet plane, a radial outlet port 12, which is formed entirely in the mantle wall of the working space. In this case, the outlet port 12 largely corresponds to the previously mentioned theoretically correct shape 3 according to FIG. 2. A valve body 13 for movement towards the outlet port 12 in the direction of the running rotors is formed with a pointed line 14 surrounded by two concave surfaces 15, 16 which, when the valve body is fully inserted, are adjacent to the outer diameter of the rotors at a minimum amount of play.

The valve body being at an angle to the outlet plane, the line of action of the valve body will intersect the outlet plane at a predetermined angle, for example 30°, and the end of the valve body must therefore comprise at least three surfaces, two of which 15, 16 are concave and are separated by a pointed line and oriented towards the rotors, and one is a plane surface 17 oriented towards the outlet plane. In the fully inserted position, the concave surfaces 15, 15 will be adjacent to the rotors at a minimum amount of play, and the plane surface 17 will be adjacent to the outlet plane 9, which will help to fix the valve body 13 for perfect adjacency to the outlet opening 12 of the rotor housing. In the fully inserted position, the end of the valve body will substantially correspond to the mantle surface of the working space. With the valve body in an inclined position, the valve body does not have to be located on the parting line between the rotor housing and the outlet plane, meaning that the sealing between the mentioned elements remains effective. The actual size of the outlet port 12 and thus of the valve body 13 is defined by the desired built-in volume relation when the outlet port is open. Further, a fixed opening 19 can be arranged in the pointed end of the valve body 13, the opening being formed such as to determine, when the port is fully closed, a certain maximum built-in volume relation. To make it possible for the valve body 13 to move, it can be associated with a control unit and an operating means or can form in itself, with its other end, a driving piston disposed in a cylinder chamber adapted for connection with the rotor housing.

It is of the utmost importance for the valve body to move on a certain plane in order not to get into a wrong position relative to its correct position in relation to the outlet port and the outlet plane; for example, the valve body can be given, for example, a substantially circular-cylindrical cross-section, whereby a good guiding surface for the valve body is achieved.

In order for the valve body not to rotate during its movement up to the outlet port and back again, the valve body can be provided with guiding means, such as grooves.

With the valve body in an inclined position relatively to the running rotors, the outlet port can be formed more or less in correspondence with the theoretical outlet port, and at the same time a fully closed sealing line between the rotor housing and the outlet plane is achieved, which also contributes towards making the rotary compressor easier to handle; for example, when the rotors are to be inspected, only the valve body has to be removed. Further, the inclined position implies forming the valve body with an oblique surface, which will move towards the outlet plane, whereby the valve body will be guided in its movement towards the outlet port and will finally be fixed in its fully inserted position.

I claim:

1. A valve device for control of the inner volume relation in a screw type rotary compressor, having an outlet port located in the rotor housing of the compressor and oriented towards the running rotors, characterized in that the outlet port (12) is axially delimited by the outlet plane and by oblique cam lines in the mantle wall of the working space, which cam lines correspond to the delimiting lines of the screw ends, and in that for the outlet port a corresponding mobile valve body (13) is arranged, which in the fully inserted position is adjacent to the outer diameter of the rotors, and that the valve body is arranged to move at an angle relatively to the outlet plane and is provided with two concave surfaces (15, 16) towards the rotor plane which are separated by a pointed line (14), and a plane surface (17) towards the outlet plane, the concave surfaces, in the fully inserted position of the valve body, being adjacent to the outer diameters of the rotors at a minimum amount of play, and the plane surface being adjacent to the surface of the outlet plane.

2. A valve device according to claim 1, characterized in that the inclined position of the valve body (13) and the inclined movement of the same make possible a fully closed sealing line on the outlet plane.

3. A valve device according to claim 1, characterized in that the guiding surface of the valve body (13) is substantially cylindrical in shape up to the valve end, which is formed such as to correspond substantially to the theoretically correct radial outlet port.

4. A valve device according to claim 1, characterized in that adjacent to its concave surfaces (15, 16) and its plane surface (17), the valve body (13) has a smaller opening which substantially has the same shape as the opening (12).

* * * * *